United States Patent [19]

Yang

[11] Patent Number: 4,807,863

[45] Date of Patent: Feb. 28, 1989

[54] VISE WITH TWO SETS OF CLAMPING JAWS

[76] Inventor: Tai-Her Yang, 5-1 Taipin St., Si-Hu Town, Dzan-Hwa, Taiwan

[21] Appl. No.: 943,775

[22] Filed: Dec. 19, 1986

[51] Int. Cl.[4] ..... B25B 1/10

[52] U.S. Cl. ..... 269/153; 269/154; 269/247; 269/287

[58] Field of Search ..... 269/152–155, 269/43, 246, 247, 906, 287; 24/525, 486

[56] References Cited

U.S. PATENT DOCUMENTS

| | | | |
|---|---|---|---|
| 851,491 | 4/1907 | Broadbooks | 269/246 |
| 1,877,781 | 9/1932 | Akerlund | 24/525 |
| 3,861,664 | 1/1975 | Durkee | 269/153 |
| 4,040,613 | 8/1977 | Kartasuk et al. | 269/247 |
| 4,066,250 | 1/1978 | Campbell | 269/153 |
| 4,241,906 | 12/1980 | Cole | 269/153 |
| 4,341,375 | 7/1982 | Romanin | 269/153 |
| 4,616,384 | 10/1986 | Lowell et al. | 24/525 |

FOREIGN PATENT DOCUMENTS

| | | | |
|---|---|---|---|
| 3209984 | 5/1983 | Fed. Rep. of Germany | 269/43 |
| 20432 | of 1908 | United Kingdom | 269/246 |

*Primary Examiner*—Robert C. Watson

*Attorney, Agent, or Firm*—Leonard Bloom

[57] ABSTRACT

An improved vise has two sets of clamping jaws. Two fixed jaws are on a fixed body and two sliding jaws are supported by a sliding body and driven simultaneously in the same direction by one threaded shaft. Each sliding jaw is paired with a fixed jaw and the fixed jaws are located between the sliding jaws. Each pair of jaws may be located in a different plane from the other pair of jaws. The second jaw pair includes a sliding jaw formed as a circumferential jaw in a horizontal plane permitting an object to be clamped vertically. Further, a third sliding jaw/fixed jaw pair may be located adjacent to the first jaw pair and may include a multiple-stepped pipe clamp claw capable of clamping pipe of various diameters. In a second embodiment, the sliding jaws are located between the fixed jaws.

7 Claims, 15 Drawing Sheets

VISE WITH TWO SETS OF CLAMPING JAWS

SUMMARY OF THE INVENTION

This is an improved structure on a vise. The main feature is that on each outer end of a sliding jaw and a fixed jaw of a traditional vise, attach a sliding jaw and a fixed jaw in a reverse facing direction. Thus, the vise set may have two sets of jaws with different opening size at the same time. It provides clamping functions with two different sized working widths.

For the vise that belongs to the front sliding jaw, both ends of its sliding part have a clamping jaw. The fixed body that functions as a sliding rail is located between the two sliding jaws which become two fixed jaws in a reverse direction.

As for the vise that belongs to the rear sliding jaw, both ends of the fixed body have fixed jaws in a reverse direction to each other.

The middle sliding body has sliding jaws facing outward in a different direction to each other.

The additional vise set of this design may adjust its sliding jaw or fixed jaw position according to requirement. Thus the clamping size capacity of the additional vise jaw set can be adjusted one step ahead. The clamp holding faces of the additional vise jaw set may have corresponding knurls in a vertical, horizontal or bias pattern. They may be replaced by a rectangular grooves for pressing a pattern. Also, a vertical or horizontal, multiple-stepped style pipe clamp claws may be made on it.

BACKGROUND OF THE INVENTION

The size of a traditional vise is indicated by its clamp jaw width. The clamp holding depth corresponds to its clamp jaw width. The extent that a vise can clamp is in proportion to the size of a clamp jaw. If various shapes of work objects and requirement under processing work exceed the vise clamping capacity, the vise is unable to clamp and one size larger vise is needed.

If one is working on different sized objects alternately, he has to change vises all the time. It is not efficient and convenient.

This design provides two sets of variable vises that may extend in opposite directions by combining an additional sliding jaw, a fixed jaw and an original sliding jaw, a fixed jaw.

When a leading threaded shaft drives a sliding unit, it produces clamping depth variations on related two sets.

The knurls in a vertical, horizontal pattern or rectangular groove or multiple-stepped style pipe clamp claws on the additional clamp jaw may clamp and press a columnar work object in upright or horizontal position. It also may be applied to press a pattern by attaching a mold.

DETAILED DESCRIPTION OF THE INVENTION

Figure 1:
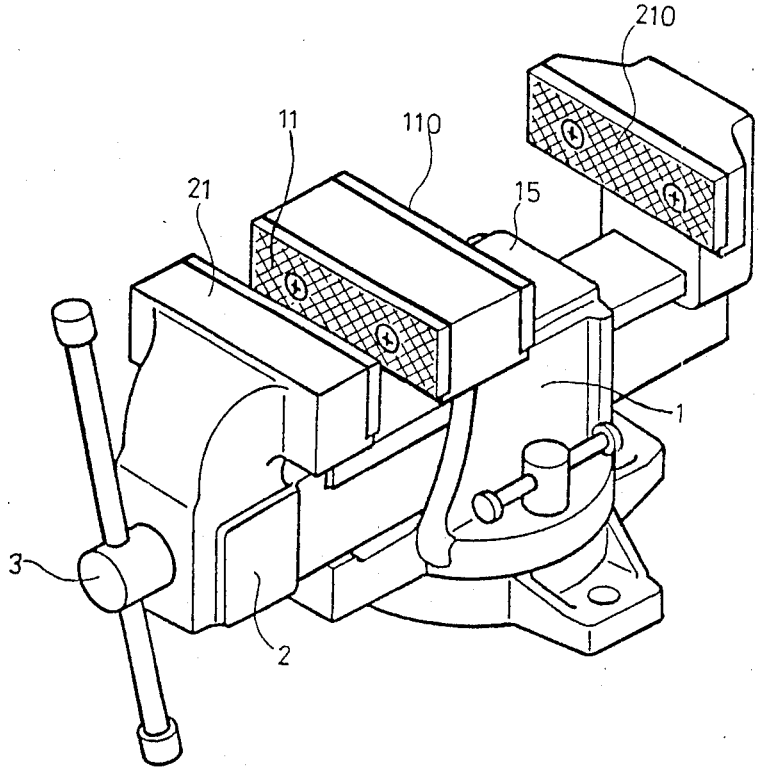
FIG. 1. A perspective view of an additional clamp jaw set consisting of a front sliding jaw and a fixed body.
Figure 2:
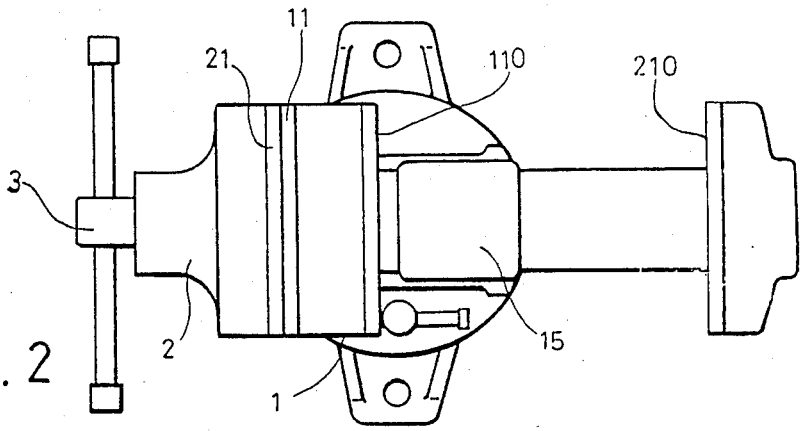
FIG. 2. A top view of an additional clamp jaw set consisting of a front sliding jaw and a fixed body.
Figure 3:
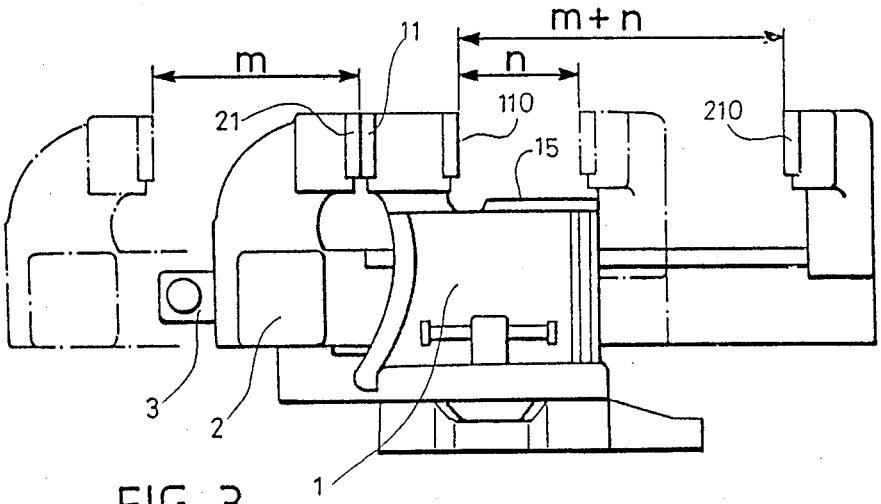
FIG. 3. A side view of an additional clamp jaw set consisting of a front sliding jaw and a fixed body.

As shown in the FIGS. 1, 2 and 3, when a vise of this invention is applied to a front sliding jaw structure type vise, two clamp jaws on the top of a fixed body 1 and two clamp jaws on a sliding body 2 create two vises corresponding to the movement variation between a sliding body and a fixed body 1.

Its structural features include:

One set of a fixed body 1 is stabilized on a work table. A main body has a smooth tunnel for inserting a sliding body 2. A leading threaded shaft 3 of a sliding body 2 is screwed into a threaded hole base inside the smooth tunnel. An additional fixed jaw 110 facing backward which is on the same level or a little bit lower is attached to the back side of a traditional fixed jaw 11 on the top of a fixed body 1. The bottom portion of the additional fixed jaw 110 extends outward as a flat base 15.

One set of a sliding body 2 has a moveable jaw 21 and a rectangular sliding root portion. That root portion is snapped into a tunnel of a fixed body. By driving a leading threaded shaft 3, the root portion may make a sliding movement inside a tunnel.

An additional moveable jaw 210 that facing toward, and in the same level with, an additional fixed jaw 110 is installed on the top end of the root portion.

A leading threaded shaft 3 used to drive is also inserted into a root portion of a sliding body 2 and screwed to a threaded hold base inside a sliding tunnel. It is used to drive a sliding body 2 to make a movement.

As shown in the FIG. 3, under its application, if a traditional clamp jaw portions 11 and 12 are in the closed situation, then the additional clamp jaw portions 110 and 210 spread wide up to the deepest depth M+N for clamping a deeper work object.

When we drive a sliding body 2 through a leading threaded shaft 3, the maximum spread out width of a traditional clamp jaw set 11 and 21 is M. The additional clamp jaw set 110 and 210 contract to N. This kind of size arrangement can obtain two sections of different clamping width.

Suppose M is from 0 to 100 mm, and from M to M+N is from 100 mm to 180 mm. When we use it, if the work object is wider than the clamping width of 100 mm, then the work object may be clamped directly by an additional clamp jaw set 110 and 210. If the work object is smaller than 100 mm, then it may be clamped by a traditional clamp jaw set with faster clamp selection.

Figure 4:
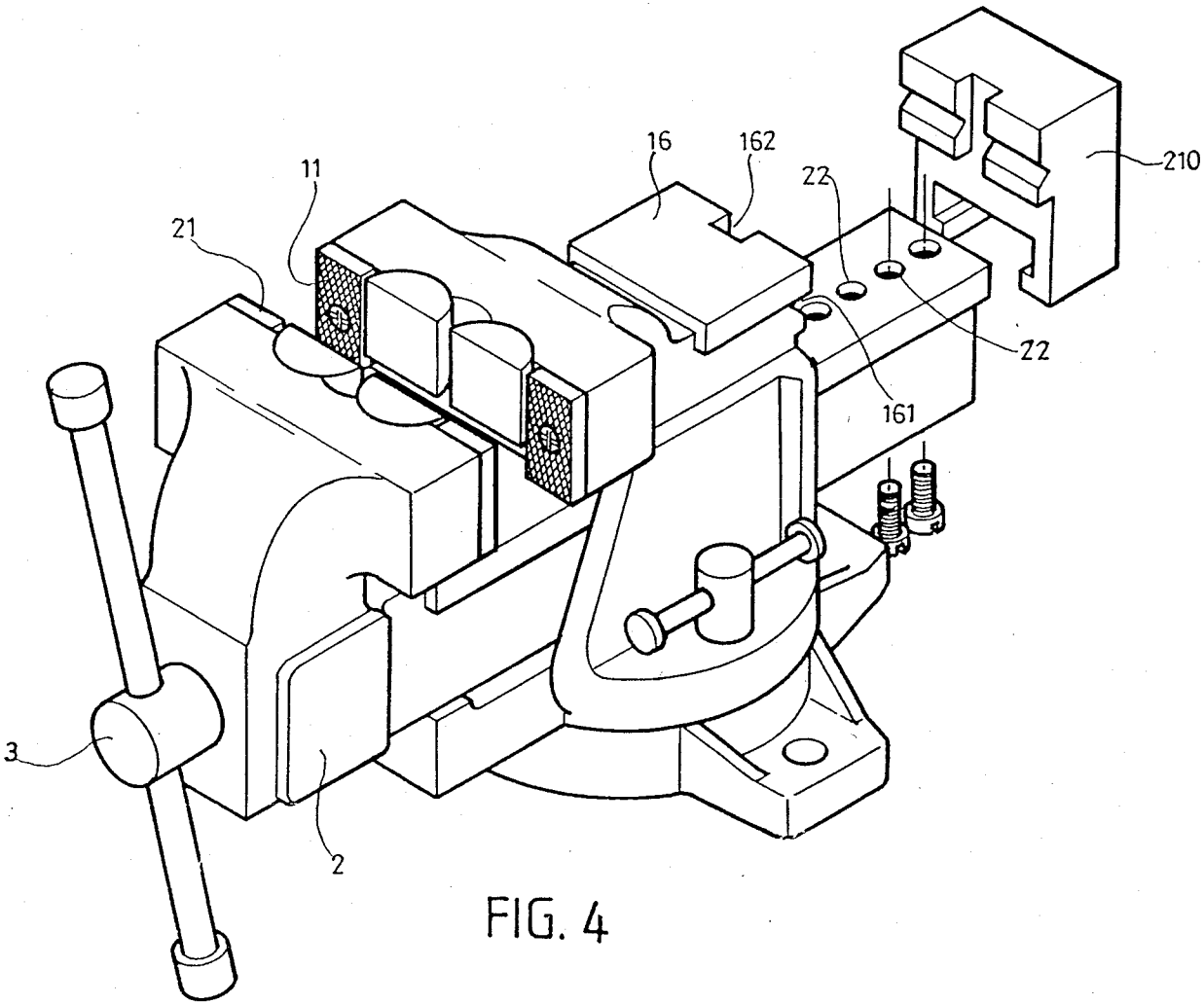
FIG. 4. A perspective view of another additional clamp jaw set consisting of a front sliding jaw and a fixed body.
Figure 5:
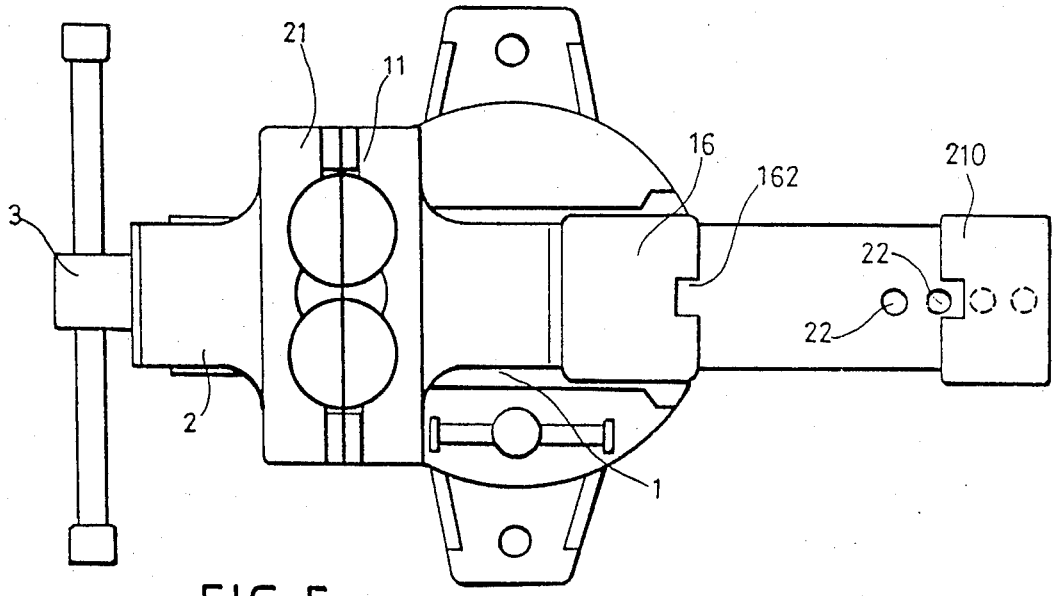
FIG. 5. A top view of another additional clamp jaw set consisting of a front sliding jaw and a fixed body.
Figure 6:
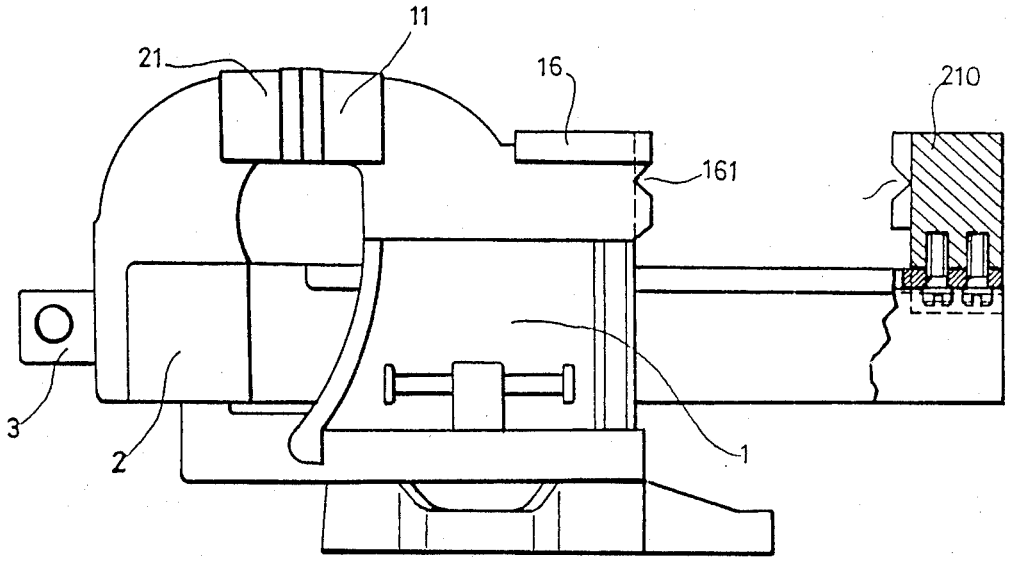
FIG. 6. A side view of another additional clamp jaw set consisting of a front sliding jaw and a fixed body.

The structure of the front sliding jaw, one step ahead, may have the structural features shown as the FIGS. 4, 5 and 6.

A little bit lower flat base 16 is made on the back side of a traditional fixed jaw 11 over a fixed body 1. On the back side surface of the flat base 16, a horizontal v-shaped groove 161 and a vertical rectangular groove 162 or a pigeon tail shaped grove are made for snapping a model.

An additional moveable jaw 210 attached to the end of a rectangular root portion of a sliding body 2 may be on the same level with a flat base 16 and create an additional clamp jaw set. This moveable jaw 210 may be welded on the root portion, or make its position adjustable. Its position can be adjusted by making a rectangular or a pigeon tail shaped groove on the root portion and bore several fixing holes 22 at equal intervals, into which an additional jaw 210 that sliding on it can be screwed tightly with a bolt. Under mass production, additional moveable jaws 210 may be pre-bolted onto the root portion of sliding bodies at the best adjusted position for a work object size.

A leading threaded shaft 3 is used to drive a sliding body to make a movement.

Figure 7:
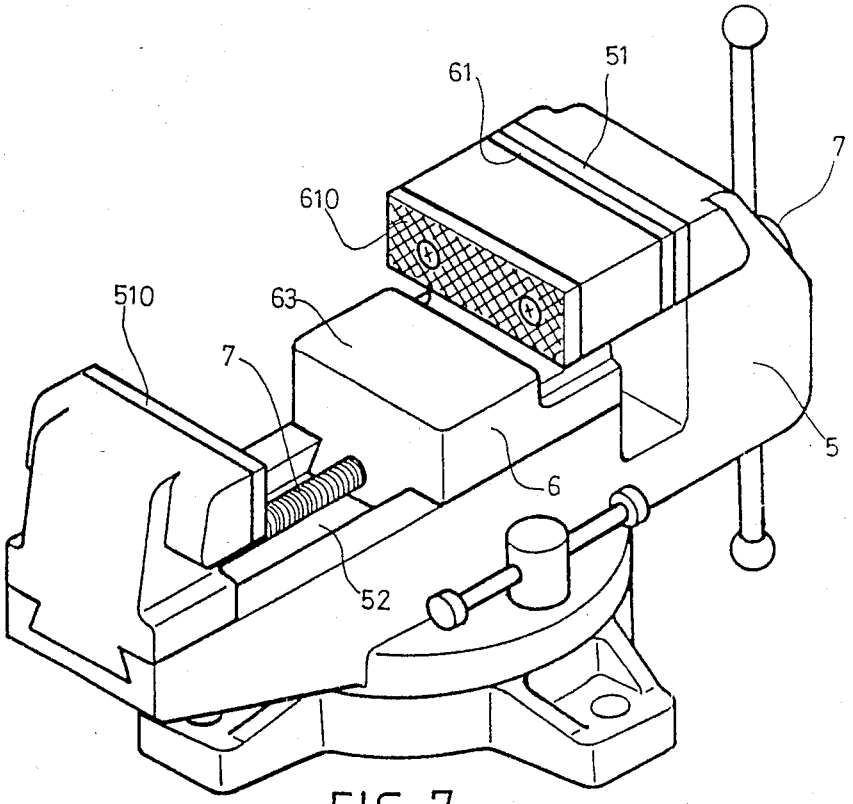
FIG. 7. A perspective view of an additional clamp jaw set consisting of a rear sliding jaw and a fixed body.
Figure 8:
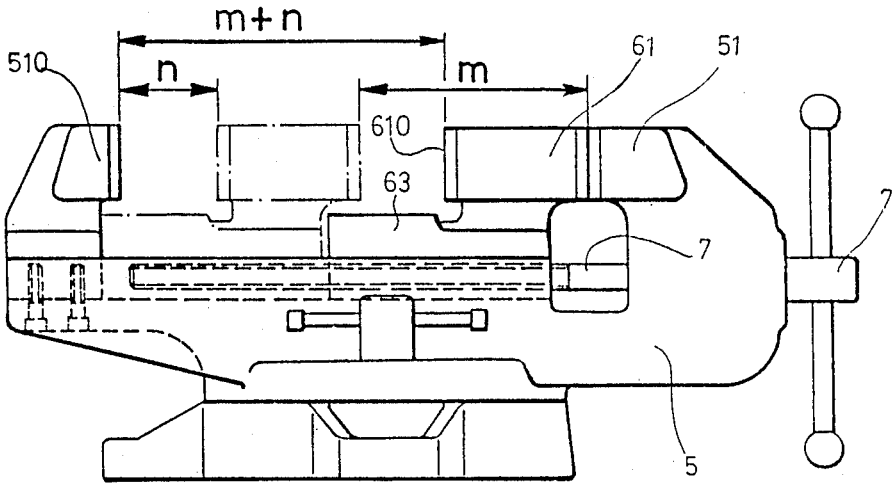
FIG. 8. A side view of an additional clamp jaw set consisting of a rear sliding jaw and a fixed body.

The FIGS. 7 and 8 show the structure that it is applied to a rear moveable jaw. A traditional clamp jaw and an additional clamp jaw on a fixed body 5 and a sliding body 6 create two vise sets.

Its specific features include:

The bottom of a fixed body 5 is stabilized on a work table with a proper structure.

A position fixing, turnable leading threaded shaft 7 is placed into the lower portion of a traditional fixing jaw 51.

A leading groove 52 (rectangular groove or pigeon tail shaped groove) is engraved on the back of the main body. A leading threaded shaft 7 is extending over the leading groove 52.

An additional fixed jaw 510 is installed to the end of the leading groove 52 on the back of the main body.

The bottom portion of a sliding body 6 that facing the leading groove 52 is made as a sliding block and is placed into the leading groove 52 and is screwed by a leading threaded shaft 7 and activated by its drive.

On this sliding body 6, there are two clamping jaws 61 and 610 facing in the different directions but on the same level. A little bit lower flat base 63 is on the front of the additional clamp jaw.

A leading threaded shaft 7 used to drive is placed in a fixed body 5 and screws into and drives a sliding body 6, allowing a sliding body 6 to move along the leading groove 52.

As shown in the FIG. 8, its clamping size may be divided into two sections. A traditional clamp jaw set 51 and 61 has the maximum clamping width of M and the minimum of 0. An additional clamp jaw set of 510 and 610 has the maximum clamping width of M+N and the minimum of N>0.

Figure 9:
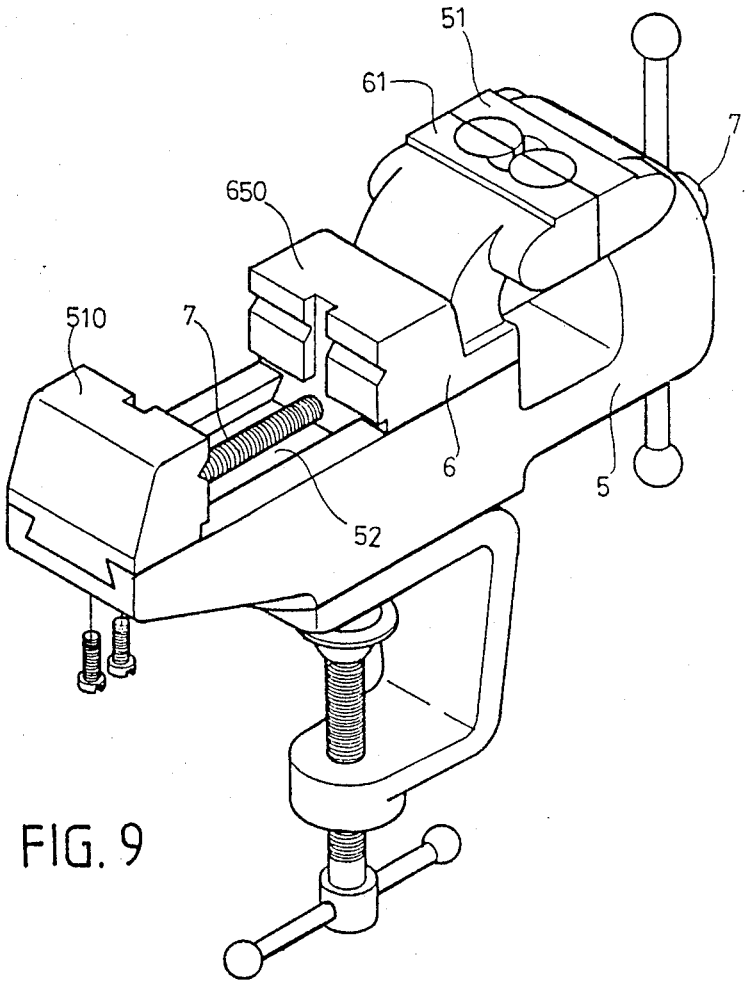
FIG. 9. A perspective view of another additional clamp jaw set consisting of a rear sliding jaw and a fixed body.
Figure 10:
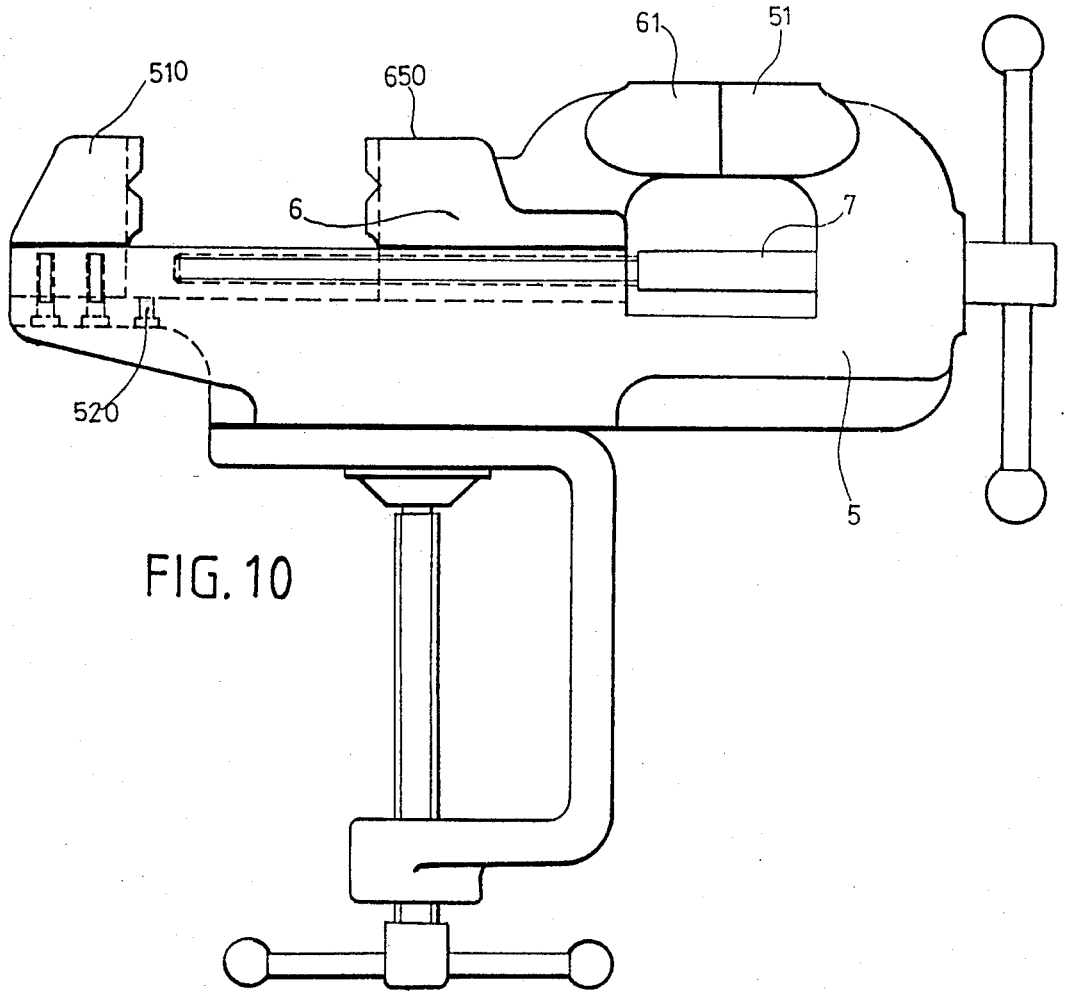
FIG. 10. A side view of another additional clamp jaw set consisting of a rear sliding jaw and a fixed body.

As shown in the FIGS. 9 and 10, the rear sliding jaw structure also can be made in the following ways:

A fixed body 5 has an additional fixed jaw 510 which is fixed in the end part of a leading groove 52. Several position fixing holes 520 are bored at even intervals on leading groove 52 for bolting an additional fixed jaw 510. Thus the position of an additional fixed jaw 510 can be pre-selected.

A sliding body 6 has a flat base 650 on the back of its traditional moveable jaw 61. The back surface of the flat base 650 and an additional fixed jaw 510 create an additional clamp jaw set.

A leading threaded shaft 7 is used to drive a sliding body 6.

On the clamping surface of the above stated additional clamp jaw set 51, 61 or 510, 650, at least one horizontal or vertical v-shaped groove, or a rectangular groove can be made to clamp a columnar bar shaped work object in a horizontal or upright position, or insert a mold to press a pattern on a work object.

Figure 11:
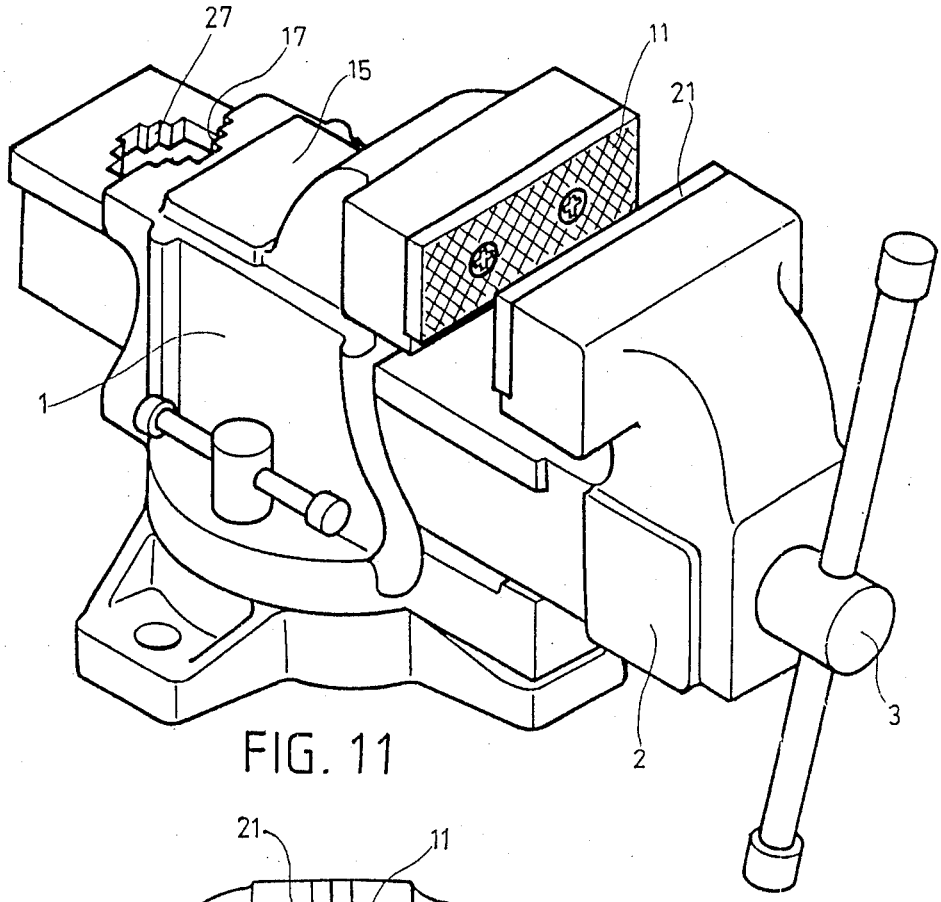
FIG. 11. A perspective view of a multiple-stepped pipe clamp claws consisting of a front sliding jaw and a fixed body.
Figure 12:
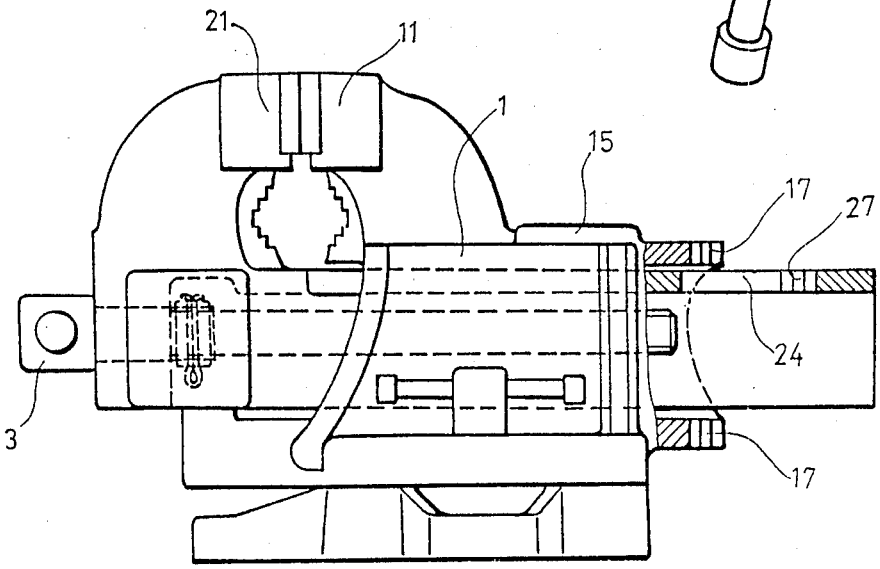
FIG. 12. A side view of a multiple-stepped pipe clamp claws consisting of a front sliding jaw and a fixed body.
Figure 13:
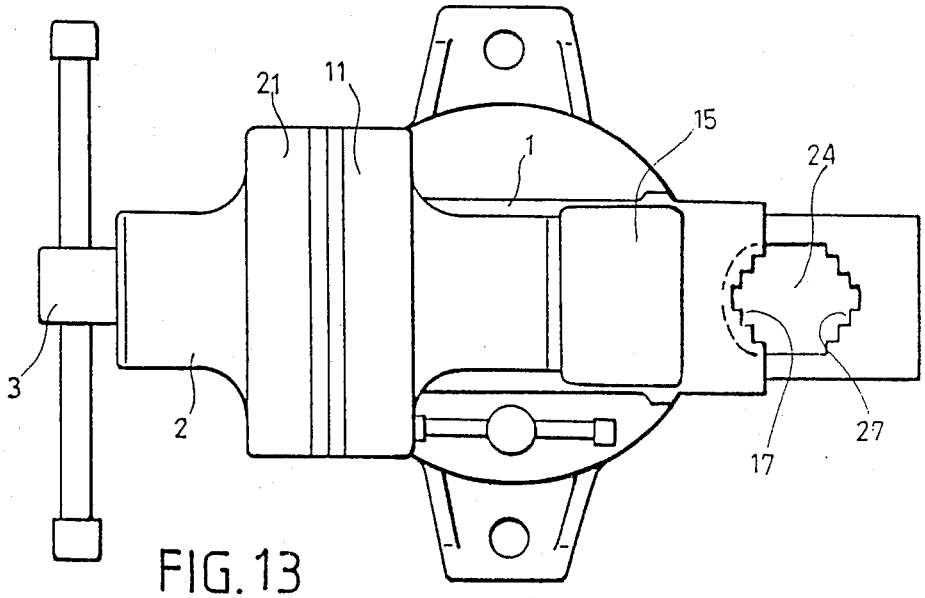
FIG. 13. A top view of a multiple-stepped pipe clamp claws consisting of a front sliding jaw and a fixed body.

The above stated structure, whether it is a front sliding jaw or a rear sliding jaw model, a multiple-stepped pipe clamp claws can be attached for clamping various sized columnar, bar shaped work object, as shown in the FIGS. 11, 12 and 13.

The specific features of the multiple-stepped style pipe clamp claws created by a fixed body 1 and a tail part of a sliding body 2 are:

On the top and bottom surface of a sliding tunnel at the tail part of a fixed body 1, two corresponding indented, multiple-stepped pipe clamp claws 17 are engraved.

On the top surface of the root of a sliding body 2 at its tail portion, bore a rectangular opening 24.

A multiple-stepped pipe clamp claw is engraved at the tail end of this rectangular opening 24, which corresponds to the multiple-stepped pipe clamp claw on the fixed body 1.

When a vice is closed as shown in the FIGS. 11 and 12, a vertical piercing opening is created by multiple-stepped pipe clamp claws of a fixed body 1 and a sliding body 2.

By using a turning adjustment structure in the base of a fixed body 1, the tail portion may be turned out to the front for inserting and clamping a long, bar-shaped work object.

While a sliding body 2 is making a sliding movement inside the fixed body 1, a tight vising action is made by a firm clamping of the sliding body 2.

The multiple-stepped pipe clamp claws 17 and 27 can clamp bars in various diameters complying with the width of each step.

Figure 14:
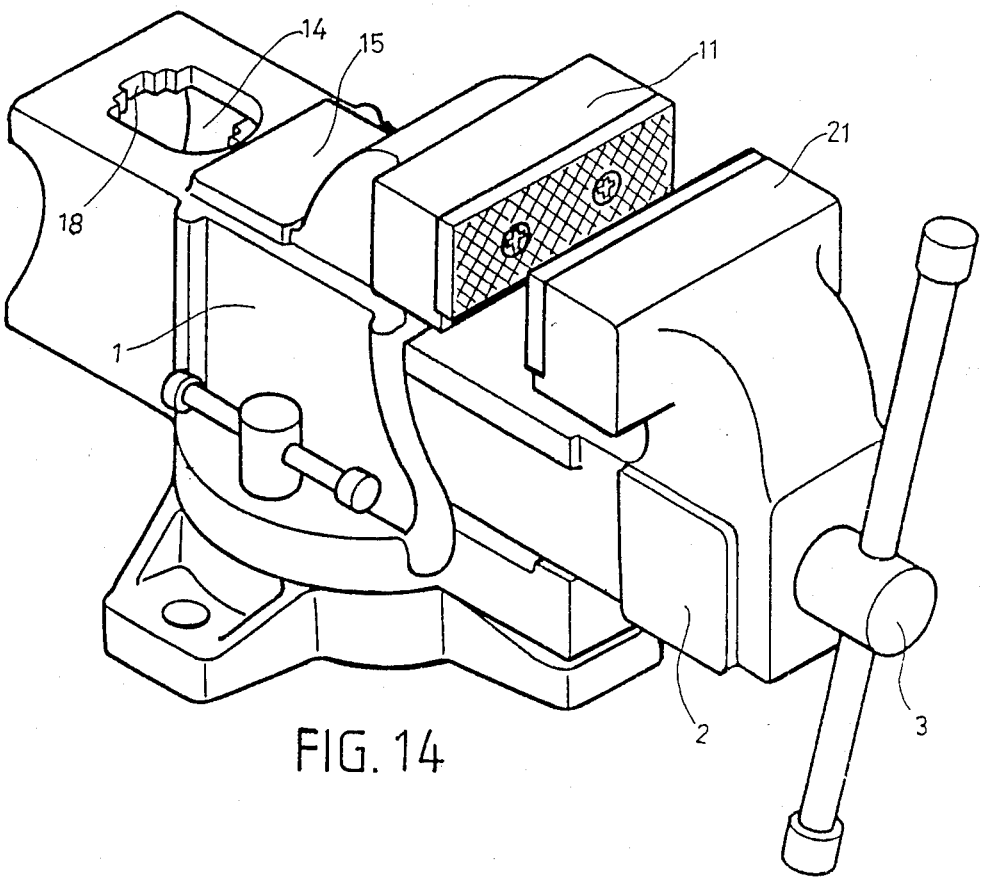
FIG. 14. A perspective view of another multiple-stepped pipe clamp claws consisting of a front sliding jaw and a fixed body.
Figure 15:
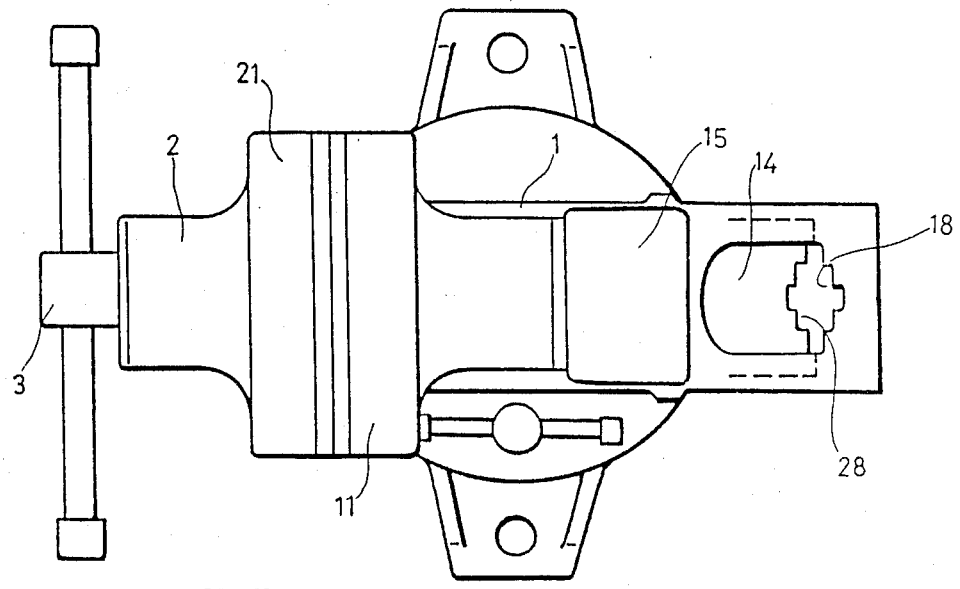
FIG. 15. A top view of another multiple-stepped pipe clamp claws consisting of a front sliding jaw and a fixed body.
Figure 16:
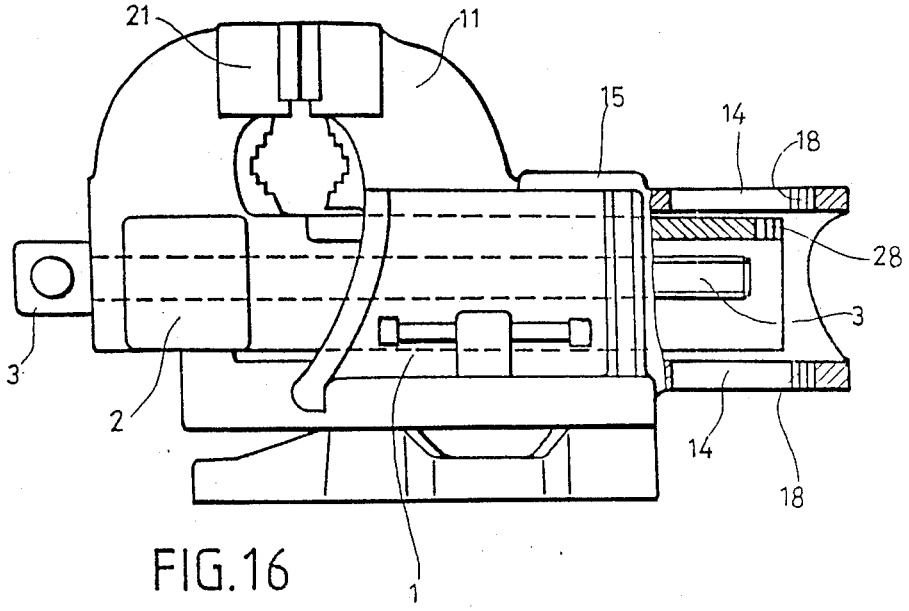
FIG. 16. A side view of another multiple-stepped pipe clamp claws consisting of a front sliding jaw and a fixed body.

FIGS. 14, 15 and 16 are one step ahead implementation examples of the multiple-stepped pipe clamp claws.

On a properly backward extended frame body from the flat surface of the fixed body 1, make a vertical opening 14. The rear edges of the top and bottom openings 14 are indented as multiple-stepped pipe clamp claws 18. On the top end edge of a sliding body 2, an indented multiple-stepped pipe clamp claw 28 is made too. When a sliding body 2 and a fixed body 1 is spread open, the multiple-stepped pipe clamp claws 18 and 28 create an opening. When it clamps on a long bar shaped work object, in compliance with the pressing direction of the moveable claws, the work object is tightly vised between the multiple-stepped pipe clamp claws 18 and 28 by applying the pushing press power method.

Figure 17:
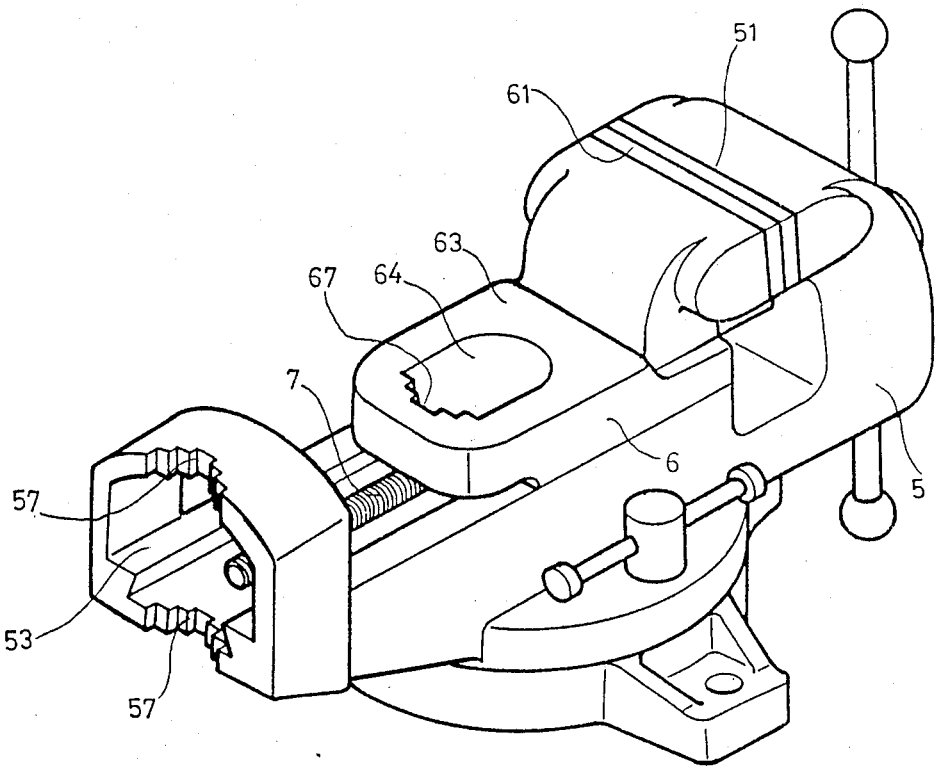
FIG. 17. A perspective view of a multiple-stepped pipe clamp claws consisting of a rear sliding jaw and a fixed body.
Figure 18:
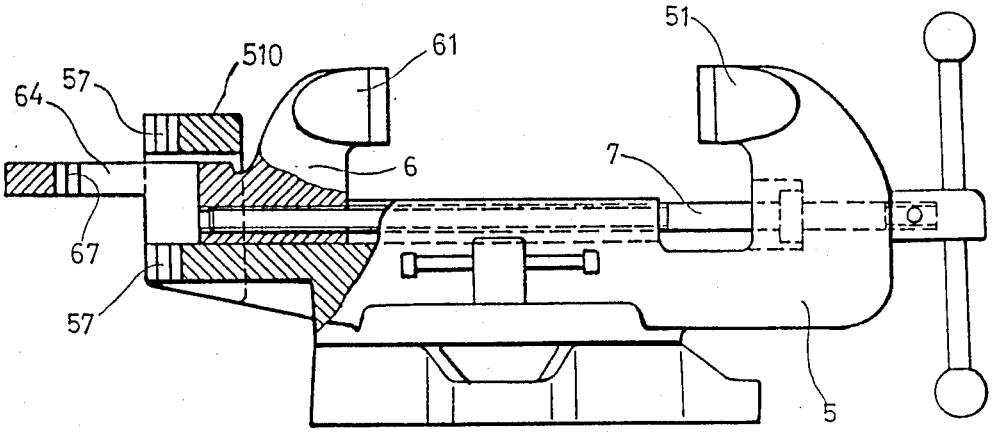
FIG. 18. A side view of a multiple-stepped pipe clamp claws consisting of a rear sliding jaw and a fixed body.
Figure 19:
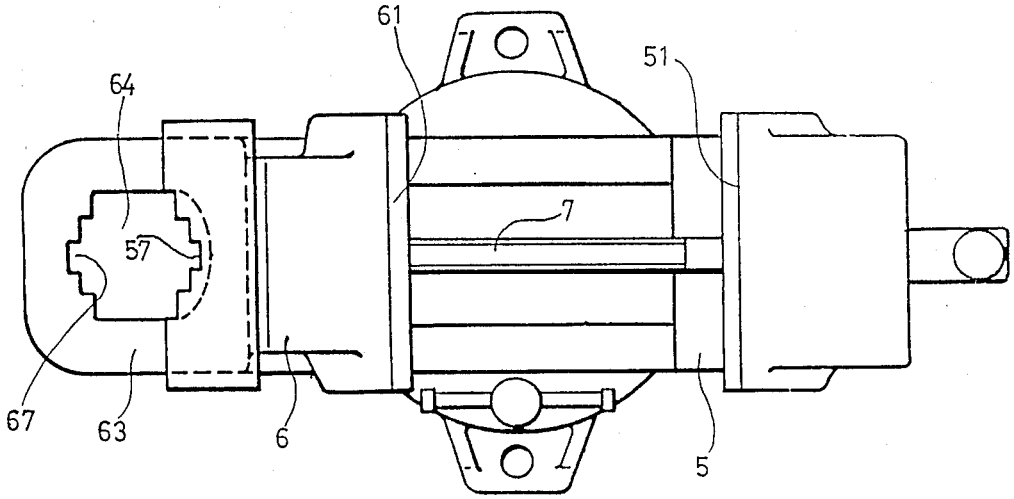
FIG. 19. A top view of a multiple-stepped pipe clamp claws consisting of a rear sliding jaw and a fixed body.

A vise structure of a rear sliding body 6 as shown in the FIGS. 17, 18 and 19 may have the following structural features for its multiple-stepped pipe clamp jaws:

A square frame 53 is attached to the back tail portion of a fixed body 5. It is a tunnel for a flat base 63 of a sliding body 6 to pass through. On the top and bottom edge of this square frame 53, backward facing indented multiple-stepped pipe clamp claws 57 are engraved.

A flat base 63 of a sliding body 6 extends backward for a certain length. Bore a piercing opening 64 at its center. The back edge of a piercing opening 64 has indented multiple-stepped pipe clamp claw 67.

For this design, a sliding body 6 has to retreat until its piercing opening 64 on the flat base 63 exceeds the square frame 53 to create a multiple-stepped pipe clamp claw sets 57 and 67 for clamping a bar shaped work object.

Figure 20:
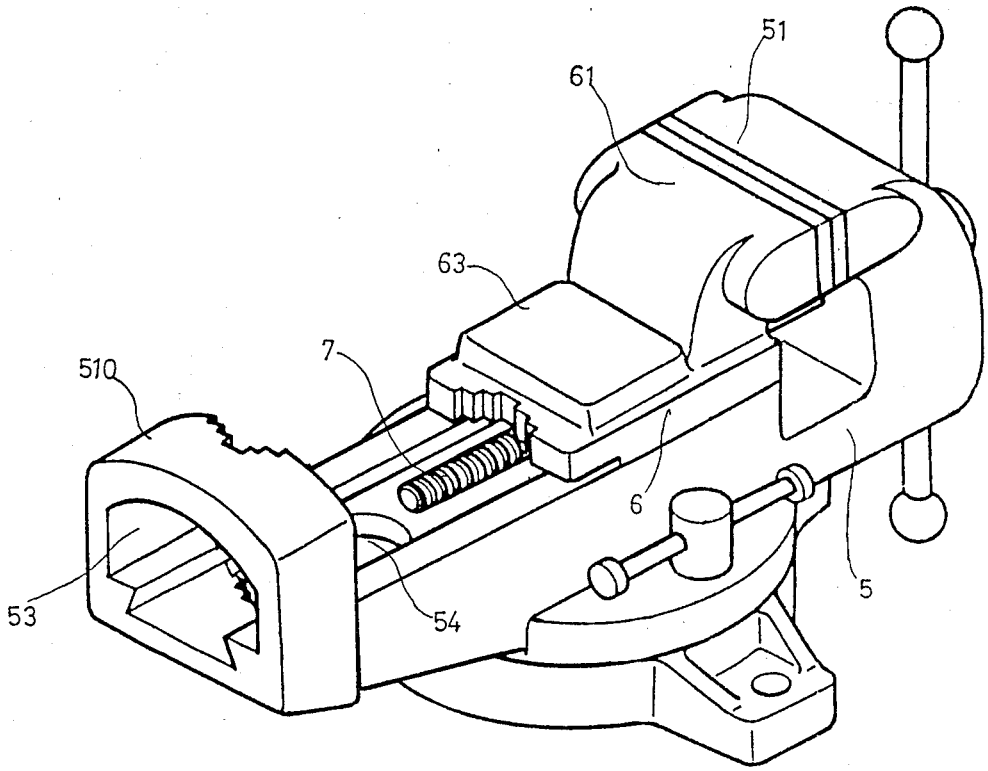
FIG. 20. A perspective view of another multiple-stepped pipe clamp claws consisting of a rear sliding jaw and a fixed body.
Figure 20A:
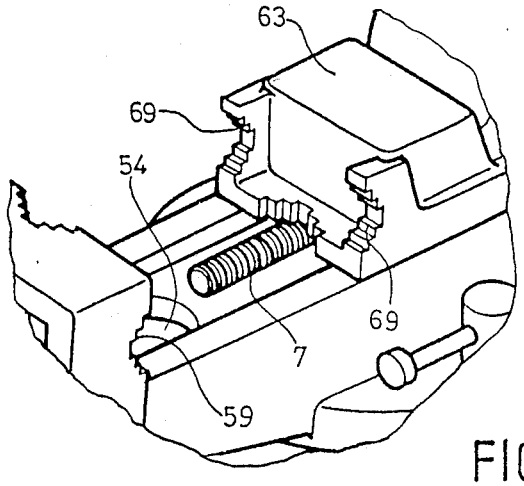
FIG. 20A is a modified portion of FIG. 20.
Figure 21:
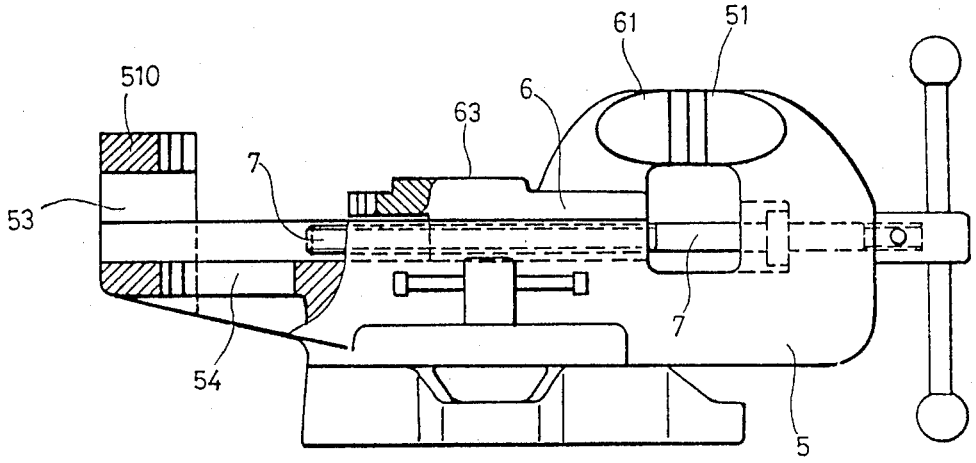
FIG. 21. A side view of another multiple-stepped pipe clamp claws consisting of a rear sliding jaw and a fixed body.
Figure 22:
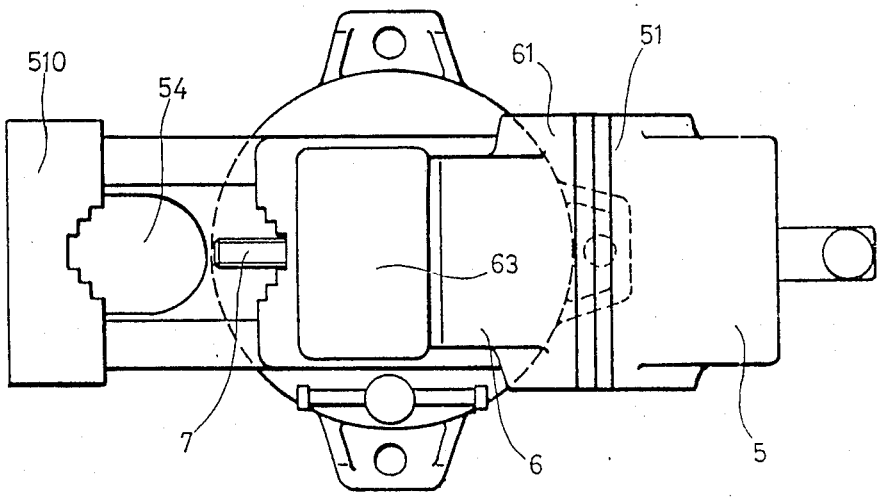
FIG. 22. A top view of another multiple-stepped pipe clamp claws consisting of a rear sliding jaw and a fixed body.

The design of multiple-stepped pipe clamp claws 57 and 67 that is placed on the rear sliding jaw may have an alternate structure as shown in the FIG. 20. The multiple-stepped pipe clamp claws 58 and 68, may reverse their positions on the square frame 53 and the flat base 63 as shown in the FIG. 20, 21 and 22. Their features are:

On the front edge of the pigeon tail groove 52 of a fixed body 5 where facing the square frame 53, bore a piercing opening 54. Make a corresponding indented multiple-stepped pipe clamp claw 58 on the front edge of a square frame 53 and the rear edge of a piercing opening 54.

The end portion of the flat base 63 of a sliding body 6 is extended directly and has an indented multiple-stepped pipe clamp claw 68.

This design enables the multiple-stepped pipe clamp claws 58 and 68 to perform the pushing clamp method and firmly vising on an upright bar-shaped work object.

One step ahead, raise the height of the square frame 53 and the flat base 63, and engrave upright multiple-stepped pipe clamp claws 59 and 69 on their both flank edges that facing each other for clamping a horizontal straight bar shaped work object.

This invention provides a wider clamping size by an additional clamp jaw set.

It enlarges the allowable clamping width of a traditional clamp jaw set.

Figure 23:
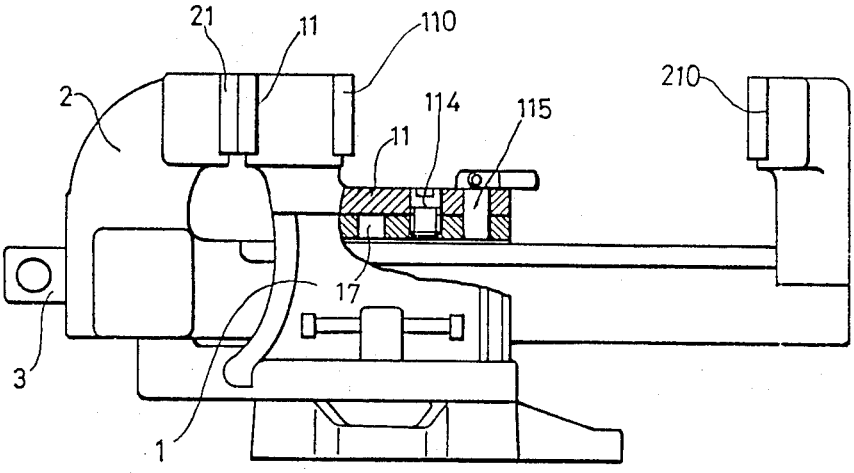
FIG. 23. A side view of a front sliding jaw type vise with a direction convertible fixed jaw.
Figure 24:
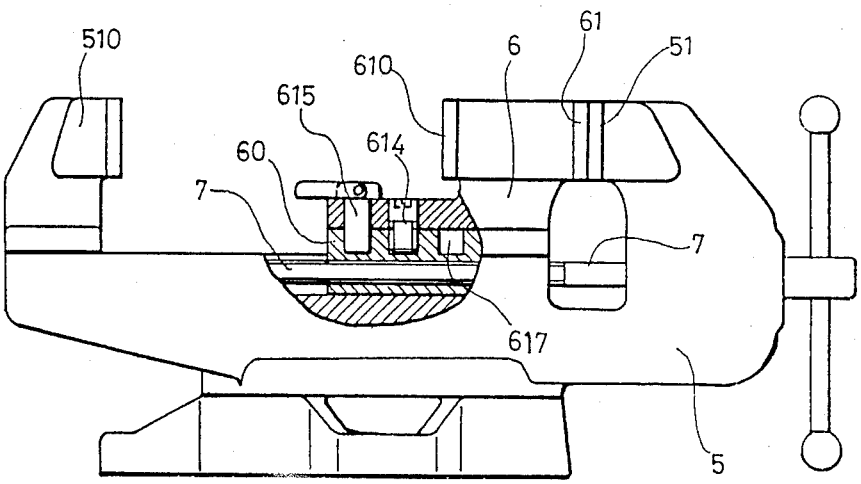
FIG. 24. A side view of a front sliding jaw type vise with a direction convertible fixed jaw.

It accomplishes its object by changing the clamping position. Shown in the FIGS. 23 and 24 is the design that does not need to change its clamping position. The specific features of a front sliding jaw structure shown in the FIG. 23 are:

A fixed body 1 and a traditional fixed jaw 11 are not molded into one body. The bottom of a fixed jaw 11 is flatly placed on the top of a fixed body 1 and is connected by a central bolt 114. On the adjoining surface of a fixed body 1, one position fixing hole 17 is bored to each of the front and rear point where a central bolt 114 is screwed. A pin 115 is attached at the rear part near a central bolt 114 is screwed into a fixed jaw 11. It is used to insert into a position fixing hole 17 for stabilizing a fixed jaw 11. A fixed jaw 11 has an L-shaped flank side and a clamp jaw on its both surfaces. As shown in the Figure, clamp jaws on the two surfaces separately create a different clamping position and size with a traditional moveable jaw 21 or an additional moveable jaw 210. When a pin 115 is pulled out and a fixed jaw 11 is turned front to back, then the clamping size of the original traditional clamp jaw is enlarged to clamp a large work object. It does not need to reverse a fixed body 1 to change the vise direction.

As shown in the FIG. 24, when it is applied to a rear sliding jaw, a moveable jaw 6 is divided into two sections. The upper section is a moveable jaw 6. The lower section is a sliding block 60. They are placed together on flat sides with a central bolt 614 as its center. By inserting a pin 615 into a position fixing hole 617, a moveable jaw 6 may make a turn and change its two clamp jaw directions, enabling to enlarge the vise size of a traditional clamp jaw set.

Summing up, the improved structure of a vise may enlarge the vise range. Now, a traditional clamp jaw part may be kept unchanged or by turning a clamp jaw to enlarge its clamp range. It may have an additional clamp jaw to make a large size clamping. A specific v-shaped or rectangular shaped groove or a multiple-stepped pipe clamp claw may be attached to an additional jaw set for enabling to clamp a bar vertically or horizontally.

A mold may be attached to press out a work object. The simple design of adding an additional jaw set and a separable jaw has excellent effect. It really has a new and practical value.

I claim:

1. A vise for clamping an object between a fixed jaw on a fixed body and a sliding jaw, said vise comprising:

two fixed jaws on the fixed body, two sliding jaws supported by a sliding body and driven simultaneously in the same direction by one threaded shaft, said two sliding jaws driven with respect to said fixed jaws, wherein said two sliding jaws and said two fixed jaws are arranged in two pairs of jaws facing each other, a first sliding jaw/fixed jaw pair and a second sliding jaw/fixed jaw pair, wherein said two fixed jaws are located between said two sliding jaws, whereby a first sliding jaw/fixed jaw pair opens and closes oppositely to a second sliding jaw/fixed jaw pair, said second sliding jaw/fixed jaw pair includes a sliding jaw formed as a circumferential jaw in a horizontal plane in said sliding body, said circumferential jaw permitting the object to be placed therethrough vertically, thereby permitting clamping of the object, wherein said fixed jaw in said second sliding jaw/fixed jaw pair cooperates with said circumferential sliding jaw for clamping the object therebetween.

2. The vise described in claim 1 wherein:

said first sliding jaw/fixed jaw pair is located in an elevated plane with respect to said second sliding jaw/fixed jaw pair.

3. The vise described in claim 1 wherein:

said sliding jaw in said first sliding jaw/fixed jaw pair is located at said front of said vise where said operator controls said opening and closing of said vise.

4. The vise described in claim 2 wherein:

said sliding jaw in said second sliding jaw/fixed jaw pair is located in a lower plane than said fixed jaw in said second sliding jaw/fixed jaw pair.

5. The vise described in claim 1 wherein:

said circumferential jaw includes a multiple-stepped pipe clamp claw capable of clamping pipe of various diameters.

6. The vise described in claim 1, further including:

a third sliding jaw/fixed jaw pair located adjacent to said first sliding jaw/fixed jaw pair, said first sliding jaw/fixed jaw pair located in an elevated plane with respect to said third sliding jaw/fixed jaw pair, and third sliding jaw/fixed jaw pair including a multiple-stepped pipe clamp claw capable of clamping pipe of various diameters.

7. A vise for clamping an object between a fixed jaw, said vise comprising:

two fixed jaws, two sliding jaws supported by a sliding body and driven simultaneously in the same direction by one threaded shaft, said two sliding jaws driven with respect to said fixed jaws, wherein said two sliding jaws and said two fixed jaws are arranged in two pairs of jaws facing each other, a first sliding jaw/fixed jaw pair and a second sliding jaw/fixed jaw pair, wherein said two fixed jaws are located between said two sliding jaws, whereby a first sliding jaw/fixed jaw pair opens and closes oppositely to a second sliding jaw/fixed jaw pair, wherein said second jaw/fixed jaw pair includes a sliding jaw formed as a circumferential jaw in a horizontal plane in said sliding body, said circumferential jaw permitting the object to be place therethrough vertically, thereby permitting clamping of the object, wherein said fixed jaw in said second sliding jaw/fixed jaw pair cooperates with said circumferential sliding jaw for clamping the object therebetween, wherein said first sliding jaw/fixed jaw pair is located in an elevated plane with respect to said second sliding jaw/fixed jaw pair, wherein said sliding jaw in said first sliding jaw/fixed pair is located at said front of said vise where said operator controls said opening and closing of said vise, wherein said sliding jaw in said second sliding jaw/-fixed jaw pair is located in a lower plane than said fixed jaw in said second sliding jaw/fixed jaw pair, wherein said circumferential jaw includes a multiple-stepped pipe clamp claw capable of clamping pipe of various diameters, further including:

a third sliding jaw/fixed jaw pair located adjacent to said first sliding jaw/fixed jaw pair, said first sliding jaw/fixed jaw pair located in an elevated plane with respect to said third sliding jaw/fixed jaw pair, said third sliding jaw/fixed jaw pair including a multiple-stepped pipe clamp claw capable of clamping pipe of various diameters.

* * * * *